US012465836B2

(12) United States Patent
Lee et al.

(10) Patent No.: US 12,465,836 B2
(45) Date of Patent: Nov. 11, 2025

(54) ROUGH MAT

(71) Applicant: GOLFZON CO., LTD., Seoul (KR)

(72) Inventors: Jung Hun Lee, Sejong-si (KR); Gwang Seok Jeon, Daejeon (KR)

(73) Assignee: GOLFZON CO., LTD., Seoul (KR)

( * ) Notice: Subject to any disclaimer, the term of this patent is extended or adjusted under 35 U.S.C. 154(b) by 289 days.

(21) Appl. No.: 18/037,547

(22) PCT Filed: Nov. 23, 2021

(86) PCT No.: PCT/KR2021/017250

§ 371 (c)(1),
(2) Date: May 17, 2023

(87) PCT Pub. No.: WO2022/108416

PCT Pub. Date: May 27, 2022

(65) Prior Publication Data

US 2023/0398423 A1 Dec. 14, 2023

(30) Foreign Application Priority Data

Nov. 23, 2020 (KR) ..... 10-2020-0158022

(51) Int. Cl.
*A63B 69/36* (2006.01)

(52) U.S. Cl.
CPC ..... *A63B 69/3661* (2013.01)

(58) Field of Classification Search
CPC ..... A63B 69/3661
USPC ..... 473/160–162, 278, 279
See application file for complete search history.

(56) References Cited

U.S. PATENT DOCUMENTS 3,690,673 A * 9/1972 Occhipinti ..... A63B 67/02 473/160
3,735,988 A * 5/1973 Palmer ..... A63B 67/02 428/17
3,892,412 A * 7/1975 Koo ..... A63B 69/3661 473/160
5,441,265 A * 8/1995 Codlin ..... A63B 67/02 473/160

(Continued)

FOREIGN PATENT DOCUMENTS

KR 20-1995-0004334 Y1 5/1995
KR 10-2004-0085811 A 10/2004
KR 10-0867752 B1 11/2008

(Continued)

OTHER PUBLICATIONS

International Search Report for PCT/KR2021/017250 mailed Mar. 2, 2022 from Korean Intellectual Property Office.

*Primary Examiner* — Nini F Legesse
(74) *Attorney, Agent, or Firm* — Revolution IP, PLLC

(57) ABSTRACT

It is an object of the present invention to provide a rough mat that can significantly increase the difficulty compared to golf shots on a fairway mat and form a terrain that makes shots difficult to provide a more realistic golf shot environment on a rough for users to have a sense of hitting on the rough. For this end, the rough mat comprises an upper plate providing a turf part on which a golf ball is placed; and a topography forming frame configured to have a pattern for forming a curved topography and provided under the upper plate so that the upper plate forms the curved topography according to the pattern of the topography forming frame.

5 Claims, 4 Drawing Sheets

(56) References Cited

U.S. PATENT DOCUMENTS

| | | | | |
|---|---|---|---|---|
| 6,056,645 | A * | 5/2000 | Servatius | A63B 67/02 473/162 |
| 2012/0178546 | A1 * | 7/2012 | Park | A63B 69/3673 473/278 |

FOREIGN PATENT DOCUMENTS

| | | | |
|---|---|---|---|
| KR | 10-0994486 | B1 | 11/2010 |
| KR | 10-2017-0021025 | A | 2/2017 |
| KR | 10-2017-0089124 | A | 8/2017 |
| WO | 02-09825 | A1 | 2/2002 |

* cited by examiner

ROUGH MAT

TECHNICAL FIELD

The present invention is related to a rough mat on which a golf ball to be shot by a user is placed when the user practices a golf shot or play virtual golf round under a rough environment in a golf driving range or a screen golf system.

BACKGROUND ART

Conventionally, a golf mat prepared for a user to play a golf shot in a driving range or a screen golf system is provided in a form of artificial turf laid on top of a rectangular plate made of rubber, and a golf ball to be shot is placed on the artificial turf of the golf mat. A golf shot is made in such a way that the user hits the golf ball on the artificial turf of the golf mat with a golf swing by using a golf club.

The conventional golf mat is divided into a fairway mat portion for practicing golf shots on a fairway environment, a rough mat portion for practicing golf shots in a rough environment, and a bunker mat portion for practicing golf shots in a bunker environment so that the golf mat allows users to practice a variety of golf shots in a variety of environments.

The conventional golf mat has a configuration in which a plate on which artificial turf is formed is placed on a rectangular plate made of rubber material having good elasticity, and conventionally the fairway mat portion is implemented with short artificial turf and the rough mat portion is implemented with long artificial turf.

However, in an actual golf course, the rough area is not simply formed with long grass or bushes, but forms various terrains, so when a user makes a golf shot in the rough area, it provides a considerably more difficult environment than the fairway area. Since conventional rough mats simply form grass longer than fairway mats on a flat plate, conventional rough mats are quite insufficient to practice golf shots in a rough environment that is much more difficult than when users take golf shots on fairway mats, and it was difficult to distinguish the conventional rough mats from the fairway mats.

In this regard, as previously disclosed prior art, there are Korean Patent Publication No. 10-2004-0085811, Korean Patent Registration No. 10-0867752, Korean Patent Publication No. 10-2017-0021025, Korean Patent Publication No. 10-2017-0089124, etc.

PRIOR ART DOCUMENTS

Korean Patent Publication No. 10-2004-0085811
Korean Patent Registration No. 10-0867752
Korean Patent Publication No. 10-2017-0021025
Korean Patent Publication No. 10-2017-0089124

DISCLOSURE

Technical Problem

It is an object of the present invention to provide a rough mat that can significantly increase the difficulty compared to golf shots on a fairway mat and form a terrain that makes shots difficult to provide a more realistic golf shot environment on a rough for users to have a sense of hitting on the rough.

Technical Solution

In accordance with an aspect of the present invention, the above and other objects can be accomplished by the provision of a rough mat that provides a golf shot environment on a rough, comprises: an upper plate providing a turf part on which a golf ball is placed; and a topography forming frame configured to have a pattern for forming a curved topography and provided under the upper plate so that the upper plate forms the curved topography according to the pattern of the topography forming frame.

Preferably, the topography forming frame is configured to form an embossing pattern by a plurality of convex parts so that the upper plate installed on the topography forming frame forms the curved topography according to the plurality of the convex parts of the embossing pattern.

Preferably, the rough mat further comprises a base plate that supports the topography forming frame and the upper plate, wherein a plurality of cavities are formed by the plurality of the convex parts between the base plate and the topography forming frame and a space part is formed between each of the convex parts between the topography forming frame and the upper plate as the upper plate is provided on the topography forming frame.

In accordance with another aspect of the present invention, there is provided a rough mat that provides a golf shot environment on a rough, comprises: an upper plate providing a turf part on which a golf ball is placed; and a topography forming frame configured to form an embossing pattern by a plurality of convex parts and provided under the upper plate so that the upper plate forms a topography of a plurality of mounds corresponding to the plurality of convex parts of the topography forming frame.

Preferably, the topography forming frame includes: a frame base configured to form the embossing pattern by the plurality of convex parts; and a plurality of cavities forming by the plurality of the convex parts so that each of the cavities forms inside of each of the convex parts.

Preferably, some or all of the plurality of cavities are filled with filler to provide a sense of hitting the mound topography by a golf club.

Preferably, the rough mat further comprises a base plate that supports the topography forming frame and the upper plate; and a lower topography frame provided between the base plate and the topography forming frame and configured to form a plurality of concave parts corresponding to the plurality of the convex parts, wherein the topography forming frame and the lower topography frame are combined corresponding to each of the plurality of the convex parts and each of the plurality of the concave parts.

Advantageous Effects

The rough mat according to the present invention has an advantageous effect that it is possible to provide a rough mat that can significantly increase the difficulty compared to golf shots on a fairway mat and form a terrain that makes shots difficult to provide a more realistic golf shot environment on a rough for users to have a sense of hitting on the rough.

BEST MODE

A rough mat according to the present invention will be more specifically described with reference to the drawings.

First, an example of configurations of the rough mat according to an embodiment of the present invention will be described with reference to FIG. 1.

Figure 1:
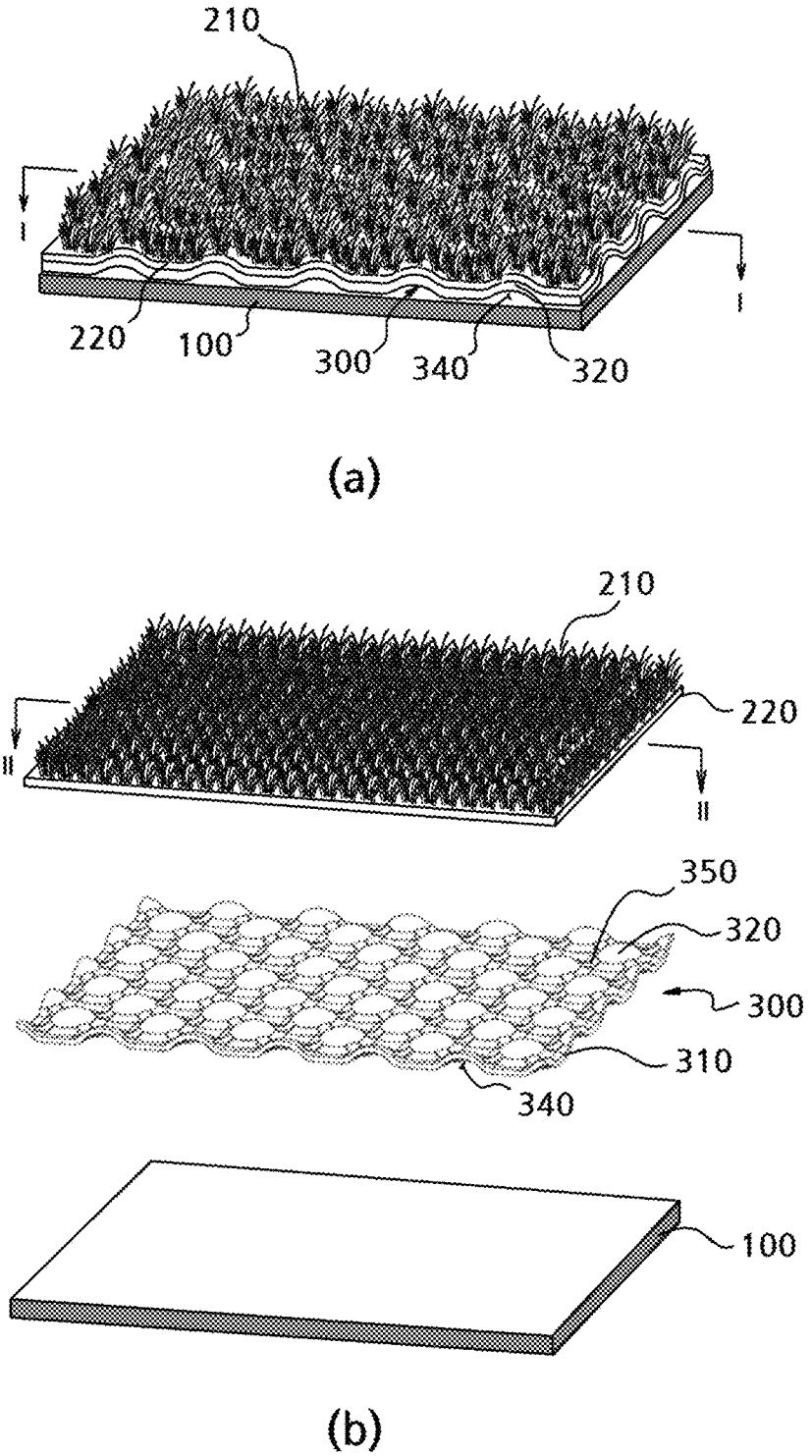
FIG. 1 shows a rough mat according to an embodiment of the present invention, (a) is a view of the overall configuration of the rough mat, and (b) is an exploded perspective view of each element of the rough mat shown in (a).

FIG. 1, (a) shows the overall configuration of the rough mat according to an embodiment of the present invention, and FIG. 1, (b) is an exploded perspective view of each element of the rough mat shown in FIG. 1, (a).

As shown in FIG. 1, the rough mat according to an embodiment of the present invention is configured to include a base plate 100, a upper plate 220 and a topography forming frame 300 provided between the base plate 100 and the upper plate 220.

The base plate 100 is installed on a floor, and supports the upper plate 220 and the topography forming frame 300. For example, the base plate 100 may be installed on the floor where the rough mat is installed in a golf shot stage in a golf driving rage or a screen golf system.

Although (a) and (b) of FIG. 1 show the base plate 100 in a simple rectangular plate shape, the present invention is not limited thereto and may have a configuration capable of protecting and supporting an upper structure.

For example, the base plate 100 may be provided in the form of a box with an open upper portion and may be configured to accommodate the topography forming frame 300 and the upper plate 220.

The base plate 100 may be made of rubber or other bufferable materials for buffering when struck by a golf club, and additional members such as a separate buffer cushion for buffering when struck may be provided at the upper portion of the base plate 100.

The upper plate 220 may be configured to have a turf part 210 where a golf ball is placed and forms an artificial turf (or may be natural grass) to provide a rough environment, and the turf part 210 may be planted on top of the upper plate 220.

The upper plate 220 may be a soft silicone or rubber material and be made of a material that can be deformed in shape according to the shape of a structure provided under the upper plate.

The topography forming frame 300 is provided under the upper plate 220, and may have a configuration to form a terrain that allows the upper plate 220 to provide a rough environment.

That is, the topography forming frame 300 may be configured to have a pattern shape for forming a curved topography of the rough mat, and may be provided at the lower part of the upper plate 220 to form a curved topography according to the pattern shape of the topography forming frame 300.

The topography forming frame 300 may be configured to have an embossing pattern, for example, so that the upper plate 220 placed thereon may implement an embossed terrain along the embossing pattern.

As shown in FIG. 1, (a) and (b), the topography forming frame 300 may be configured to include a frame base 310 and a plurality of convex parts 320 formed on the frame base 310, wherein the topography forming frame 300 may be configured to form a cavity 340 under each of the plurality of convex parts 320.

As shown in FIG. 1, (a) and (b), the topography forming frame 300 may be configured to form an embossing pattern having a number of convex parts 320 convexly formed upward in a dome shape or a similar shape.

The topography forming frame 300 forms a plurality of the convex parts 320 and the lower part of each convex part 320 is configured to form a cavity 340. That is, the plurality of the convex parts 320 are provided on the upper portion of the topography forming frame 300 and the plurality of the cavities 340 on the contrary are provided on the lower portion of the topography forming frame 300.

The plurality of convex parts 320 formed on the topography forming frame 300 may be formed in a pattern such that a plurality of small dome-shaped convex parts are arranged somewhat densely, as shown in FIG. 1, (b). In addition, for example, it may be formed in a dome shape having a size of four to five convex parts 320 shown in FIG. 1, (b). As described above, the convex part may be configured in various sizes and shapes.

The topography forming frame 300 may be configured to have a support 350 between each of the convex parts to support the shape of each of the convex parts 320 as shown in FIG. 1, (b).

As shown in FIG. 1, (b), a upper plate 220 is provided on the top of the topography forming frame 300. By placing the upper plate 220 on the topography forming frame 300, the upper plate 220 can be configured to form a mound (upward bulging shape) corresponding to each of the convex parts 320 provided on the topography forming frame 300.

That is, as shown in FIG. 1, (a) and (b), the upper plate 220 can form multiple bulging terrain in response to multiple convex parts 320 of the topography forming frame 300 by placing the upper plate 220 on the topography forming frame 300.

As described above, what type of bulging terrain is formed on the upper plate 220 depends on the shape of the pattern of the topography forming frame 300 and the material of the upper plate 220.

For example, if the material of the upper plate 220 is very soft and easily deformed by external force, a relatively high mound or a relatively deep curve may be formed according to the shape of the convex part 320 formed by the topography forming frame 300. If the material of the upper plate 220 is not greatly deformed, a relatively low mound or a relatively shallow curve may be formed according to the shape of the convex part 320 formed by the topography forming frame 300.

In addition, the smaller the size of the convex part 320 formed in the topography forming frame 300, the smaller the degree of curvature formed in the upper plate 220, and the larger the size of the convex part 320, the greater the degree of curvature formed in the upper plate 220.

In the rough mat according to an embodiment of the present invention, the terrain formed by the embossing pattern according to a plurality of convex parts of the topography forming frame includes not only a high-rise mound but also a low-rise gentle mound. In addition, even if the upper plate is formed almost flat enough to be difficult to identify whether a hill is formed on the surface, according to the club head is caught in the convex part of the topography forming frame when a golf club hits the upper plate during a golf shot, a user can obtain to feel a hitting sense as hitting the convex mound.

The 'mound topography' on the upper plate appearing in the present specification may include various types of mounds as described above.

Meanwhile, as described above, according to the upper plate 220 forms a plurality of mound topography according to an embossing pattern by a plurality of convex parts of the topography forming frame 300, the rough mat can implement a higher level of difficulty than a simple flat turf mat when hitting a golf club due to the turfs length of the turf part 210 and the multiple mound topography as described above. In addition, the rough mat can implement a non-uniform difficulty, that is, a random difficulty, due to the turf s length of the turf part 210 and the multiple mound topography as described above.

Wherein, the non-uniform random difficulty means that the hitting sense when a club head hits on the rough mat during a golf shot may vary depending on where the golf ball is placed on the rough mat.

In the case of conventional even and flat golf mat, there was a problem that almost the same hitting sense was always obtained no matter where a golf ball was placed and hit. On the other hand, in the rough mat according to an embodiment of the present invention as described above, the upper plate forms a plurality of mound topography by the topography forming frame, thereby each location where the golf ball is placed can provide a different sense of hitting to the user.

For example, when a club head hits on the upper plate during a golf shot with respect to a golf ball placed on some locations on the rough mat, the user may feel a hitting sense giving a very difficult hitting according to the club head may be accurately caught in the protruding portion. In some locations, when hitting the golf ball, the user may not hit the golf ball according to the end of the clubhead may be caught in the lower portion of the mound. In some locations, when hitting the golf ball, the user may feel a hitting sense that allows the club head to pass through the top of the mound. In this way, the rough mat according to an embodiment of the present invention may provide various and random hitting senses as described above.

Even when a user hits a golf ball on an actual golf course, it is very difficult to hit a golf ball in a rough area than on a fairway. This is because strikes in rough areas are unpredictable by the variety of terrain (i.e., whether a golf ball in a rough area is easy to hit is quite random).

The rough mat according to an embodiment of the present invention may also provide an environment capable of various and random hittings by forming a plurality of mound topography by the topography forming frame as described above.

Figure 2:
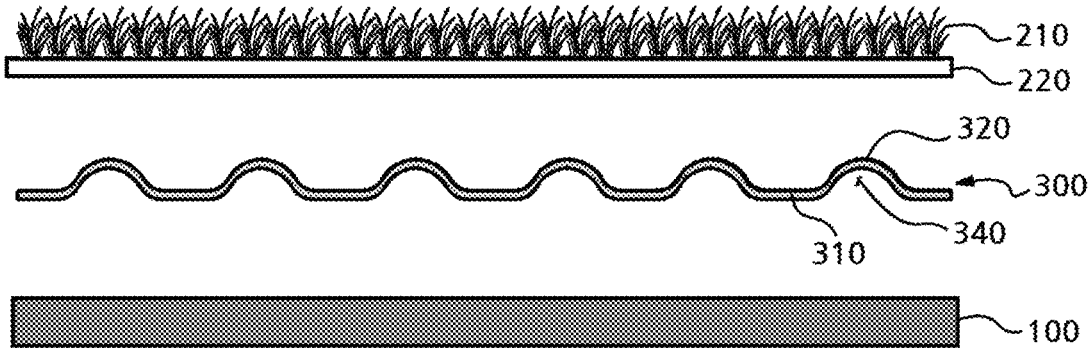
FIG. 2 shows an II-II cross-section of (b) in FIG. 1 as a state of decomposition for each element of the rough mat according to an embodiment of the present invention.
Figure 3:
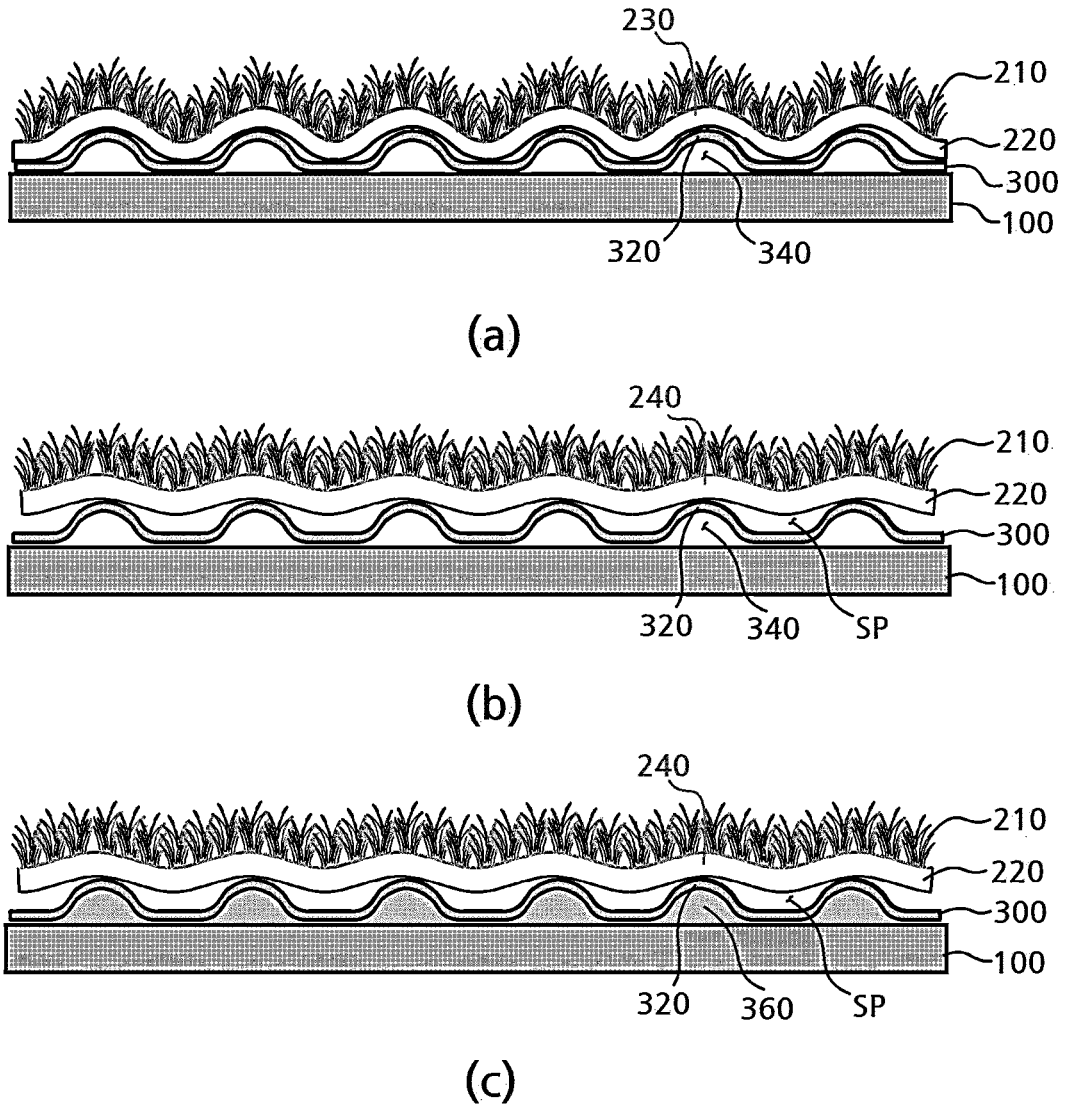
FIG. 3 shows cross-sections of the rough mat according to embodiments of the present invention, (a) is a view of an I-I cross-section of (a) in FIG. 1, (b) is a view of another cross-section of (a) in FIG. 3, and (c) is a view of a cross-section of a rough mat according to another embodiment of the present invention.

Meanwhile, the rough mat according to an embodiment of the present invention will be described with reference to FIGS. 2 and 3. FIG. 2 shows a II-II cross-section of FIG. 1, (b) as a state of decomposition for each element of the rough mat according to an embodiment of the present invention. FIG. 3, (a) shows an I-I cross-section of (a) in FIG. 1, FIG. 3, (b) shows another cross-section of (a) in FIG. 3, and FIG. 3, (c) shows a cross-section of a rough mat according to another embodiment of the present invention.

As shown in FIG. 2, the rough mat according to an embodiment of the present invention may be configured that the topography forming frame 300 is installed on the base plate 100, a upper plate 220 is installed on the topography forming frame 300 and the turf part 210 forming an artificial turf for providing a rough environment may be provided on the upper plate 220.

Wherein, another buffer cushion may be provided between the base plate 100 and the topography forming frame 300 to alleviate the impact of the golf club hitting the rough mat.

As shown in FIG. 2, the topography forming frame 300 may be configured to include the frame base 310, the plurality of the convex parts 320 formed on the frame base 310, and a plurality of the cavities 340 formed under the plurality of the convex parts 320.

As described above, if the topography forming frame 300 is installed on the base plate 100 and the upper plate 220 with soft silicon or rubber is installed thereon, the shape of the upper plate 220 is deformed according to the embossing pattern of the topography forming frame 300 and the upper plate 220 can form a curved terrain or a topography having a plurality of mounds 230, as shown in FIG. 3, (a).

In FIG. 3, (a), the upper plate 220 of the rough mat is illustrated somewhat excessively curved along the embossing pattern by the plurality of convex parts 320 of the topography forming frame 300. However, in reality, the upper plate may show a significantly softer curve than the one shown in FIG. 3, (a). FIG. 3, (b) shows an example of the rough mat having such a gentle mound 240 topography.

The rough mat shown in FIG. 3, (b) also has the same configuration as FIG. 2 and FIG. 3, (a). In other words, the topography forming frame 300 is installed on the base plate 100, a upper plate 220 is installed on the topography forming frame 300 and the turf part 210 forming an artificial turf for providing a rough environment may be provided on the upper plate 220. The topography forming frame (300) may be configured to form a cavity (340) under each of the plurality of convex parts (320) formed on the base (310), and the plurality of convex parts (320). The topography forming frame 300 may be configured to include the frame base 310, the plurality of the convex parts 320 formed on the frame base 310, and a plurality of the cavities 340 formed under the plurality of the convex parts 320.

The topography forming frame 300 allows a gentle mound 240 to be formed on the upper plate 220 to provide a golf shot environment in the rough and can provide a sense of unpredictable golf shot in the rough to a user who takes a golf shot.

In addition, since the topography forming frame 300 has a relatively recessed shape between each of the convex parts 320, a space part SP may be formed between each of the convex parts 320 between the topography forming frame 300 and the upper plate 220 when the upper plate 220 is mounted on the topography forming frame 300, as shown in FIG. 3, (b). The size of the space part SP may change according to how much the upper plate 220 is deformed by the topography forming frame 300.

That is, as shown in FIG. 3, (b), the rough mat may be configured to form a plurality of cavities 340 by a plurality of the convex parts 320 between the base plate 100 and the topography forming frame 300, while forming a space part SP between each of the convex parts 320 between the topography forming frame 300 and the upper plate 220.

By configuring the rough mat as described above, depending on where the golf ball is placed on the rough mat, a variety of hitting feelings can be provided by the combination of the convex part 320, the space part SP, and the cavity 340.

Wherein, the plurality of the convex parts 320 may provide feeling of resistance or irritation through the club head when hitting the mat during a golf shot, while the cavity 320 serves as a buffer by making the hit convex part 320 easily deformed, and the space part SP can provide feeling of the club head recessed when hitting.

Therefore, the combination of the plurality of convex parts 320, the cavity 340, and the space part SP as described above can provide various hitting feelings to the golf club when hitting.

Meanwhile, FIG. 3, (c) shows a state in which some or all of the plurality of cavities 340 formed under the plurality of convex parts 320 formed in the topography forming frame 300 are filled with soft fillers 360 in the rough mat shown in FIG. 3, (b).

As described above, by filling the cavities 340 with fillers 360, it is possible to give elasticity to the convex part 320 being deformed by the impact when hitting the rough mat with the golf club, thereby increasing the durability of the topography forming frame 300 and providing a higher sense of resistance when hitting.

Meanwhile, a configuration of a rough mat according to another embodiment of the present invention will be described with reference to FIG. 4.

Figure 4:
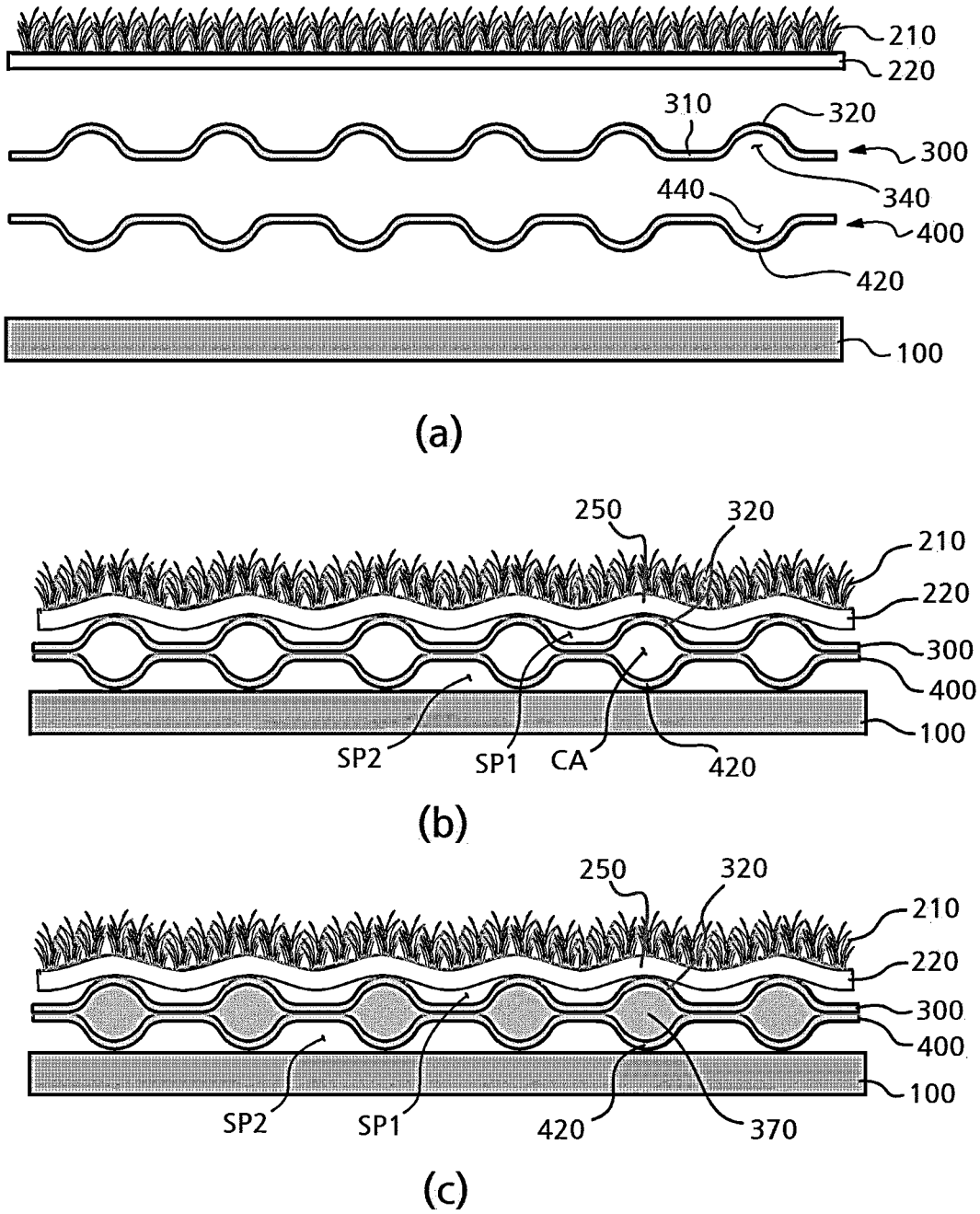
FIG. 4 shows cross-sections of the rough mat according to other embodiments of the present invention, (a) is a view of a cross-section showing a state in which the rough mat according to another embodiment of the present invention is decomposed for each element, (b) is a view of a rough mat that combines all elements shown in (a) in FIG. 4, and (c) is a view of a state in which an inner space formed by a convex part and a concave part is filled with a filler in the rough mat shown in (b) in FIG. 4.

FIG. 4, (a) shows a cross-sectional view showing a state in which the rough mat according to another embodiment of the present invention is decomposed for each element, FIG. 4, (b) shows a rough mat that combines all elements shown in FIG. 4, (a), and FIG. 4, (c) shows a state in which an inner space formed by a convex part and a concave part is filled with a filler in the rough mat shown in FIG. 4, (b).

As shown in FIG. 4, (a), a rough mat according to another embodiment of the present invention may have a configuration that on the base plate 100, a topography forming frame 300 and a lower topography frame 400 are placed facing each other, an upper plate 220 is placed on the top of the topography forming frame 300, and a turf part 210 forming a turf to provide a rough environment is placed on the upper plate 220.

The topography forming frame 300 may be configured to include a frame base 310, a plurality of convex parts 320 formed on the frame base 310, and a cavity 340 under each of the plurality of convex parts 320, as shown in FIG. 4, (a).

The lower topography frame 400 forms a plurality of concave parts 420 corresponding to the plurality of the convex parts 320 of the topography forming frame 300, as shown in FIG. 4, (a). The topography forming frame 300 and the lower topography frame 400 can be combined, bonded, or integrated in contact with each other so that each of the plurality of concave parts 420 corresponds to each of the plurality of convex parts 320.

The combination of the topography forming frame 300 and the lower topography frame 400 may be structurally combined, combined by a separate means, bonded to each other, or formed integrally.

The lower topography frame 400 may be an inverted topography forming frame 300 or may be made as a separate component.

As described above, if the topography forming frame 300 and the lower topography frame 400 are combined and placed on the base plate 100 and the upper plate 220 with soft silicon or rubber is installed on the topography forming frame 300, as described in FIG. 4, (b), the shape of the upper plate 220 is deformed according to the embossing pattern of the topography forming frame 300 and forms a topography with a curve or a plurality of mounds 250.

By configuring the rough mat as described in FIG. 4, (b), each of the convex parts 320 of the topography forming frame 300 and each of the concave parts 420 of the lower topography frame 400 can be matched to each other to make a larger inner space CA therein. In addition, it is possible to have a more effective buffering function by providing a number of two types of space between the topography forming frame 300 and the upper plate 220, wherein the two types of space include a first space part SP1 forming between each of the convex parts 320 between the topography forming frame 300 and the upper plate 220 and a second space part SP2 forming between each of the concave parts 420 between the topography forming frame 300 and the base plate 100.

Meanwhile, FIG. 4, (c) shows a state in which each of the inner spaces CA formed by the plurality of the convex parts 320 of the topography forming frame 300 and the plurality of the concave parts 420 of the lower topography frame 400 is filled with a filler 370 in the rough mat shown in FIG. 4, (b).

As described above, by filling the inner spaces CA with filler 370, elasticity can be given to the convex parts 320 being deformed by the impact when hitting the rough mat with the golf club, thereby durability of the topography forming frame 300 may be increased and a higher sense of resistance may be provided when hitting.

As described above, the rough mat according to the present invention has an advantageous effect that it is possible to provide the rough mat that can significantly increase the difficulty compared to golf shots on a fairway mat and form a terrain that makes shots difficult to provide a more realistic golf shot environment on a rough for users to have a sense of hitting on the rough.

INDUSTRIAL APPLICABILITY

The rough mat according to the present invention may be used in industrial fields related to golf practice and so-called screen golf industry fields that allow golf play to be enjoyed based on virtual golf simulations.

The invention claimed is:

1. A rough mat that provides a golf shot environment on a rough, comprising:

an upper plate providing a turf part on which a golf ball is placed; and a topography forming frame configured to have a pattern for forming a curved topography and provided under the upper plate so that the upper plate forms the curved topography according to the pattern of the topography forming frame, wherein the topography forming frame is configured to form an embossing pattern by a plurality of convex parts so that the upper plate installed on the topography forming frame forms the curved topography according to the plurality of the convex parts of the embossing pattern, and each of the convex parts includes a support provided between the adjacent convex parts to maintain a shape of each of the convex parts.

2. The rough mat according to claim 1, further comprising a base plate that supports the topography forming frame and the upper plate, wherein a plurality of cavities are formed by the plurality of the convex parts between the base plate and the topography forming frame and a space part is formed between each of the convex parts between the topography forming frame and the upper plate as the upper plate is provided on the topography forming frame.

3. A rough mat that provides a golf shot environment on a rough, comprising:

an upper plate providing a turf part on which a golf ball is placed; and a topography forming frame configured to form an embossing pattern by a plurality of convex parts and provided under the upper plate so that the upper plate forms a topography of a plurality of mounds corresponding to the plurality of convex parts of the topography forming frame, wherein the to forming frame includes:

a frame base configured to form the embossing pattern by the plurality of convex parts; and a plurality of cavities formed by the plurality of the convex parts so that each of the cavities forms inside of each of the convex parts, and wherein each of the convex parts includes a support provided between the adjacent convex parts to maintain a shape of each of the convex parts.

4. The rough mat according to claim 3, wherein some or all of the plurality of cavities are filled with filler to provide a sense of hitting the mound topography by a golf club.

5. The rough mat according to claim 3, further comprising:

a base plate that supports the topography forming frame and the upper plate; and a lower topography frame provided between the base plate and the topography forming frame and configured to form a plurality of concave parts corresponding to the plurality of the convex parts, wherein the topography forming frame and the lower topography frame are combined corresponding to each of the plurality of the convex parts and each of the plurality of the concave parts.

* * * * *